United States Patent [19]

LaBrecque

[11] Patent Number: 4,945,733

[45] Date of Patent: Aug. 7, 1990

[54] REFRIGERATION

[76] Inventor: James C. LaBrecque, P.O. Box 2113, Bangor, Me. 04401

[21] Appl. No.: 440,982

[22] Filed: Nov. 22, 1989

[51] Int. Cl.[5] ..... F25B 47/02

[52] U.S. Cl. ..... 62/278; 62/509; 62/510; 62/513

[58] Field of Search ..... 62/510, 509, 513, 175, 62/278

[56] References Cited

U.S. PATENT DOCUMENTS

| | | | |
|---|---|---|---|
| 3,307,369 | 3/1967 | Harnish | 62/513 X |
| 3,766,745 | 10/1973 | Quick | 62/278 X |
| 4,621,505 | 11/1986 | Ares et al. | 62/510 X |
| 4,628,706 | 12/1986 | Neudorfer | 62/278 |
| 4,748,820 | 6/1988 | Shaw | 62/510 X |
| 4,803,848 | 2/1989 | LaBrecque | 62/183 |
| 4,813,239 | 3/1989 | Olson | 62/510 X |
| 4,831,835 | 5/1989 | Beehler et al. | 62/509 X |

*Primary Examiner*—William E. Tapolcal, Jr.
*Attorney, Agent, or Firm*—Henry D. Pahl, Jr.

[57] ABSTRACT

The refrigeration system disclosed herein operates evaporators in both moderate and low temperature environments, respective compressors being associated with each type of evaporator. A condenser is provided for rejecting heat into the environment. Refrigerant from the condenser is provided both to the moderate temperature evaporators and to a refrigerant processing vessel which can allow a mixture of gas and liquid phase refrigerant to separate. A heat exchanging conduit is submerged in the liquid phase refrigerant in the lower portion of the processing vessel and the outlets of the compressors serving the low temperature evaporators are connected to the inlet end of that conduit. Liquid phase refrigerant from the processing vessel is provided to the low temperature evaporators. An intake is provided in the upper portion of the processing vessel for drawing off gas phase refrigerant and that intake and the outlet end of the heat exchanging conduit are connected together and to the inlet side of a compressor serving a moderate temperature evaporator.

11 Claims, 1 Drawing Sheet

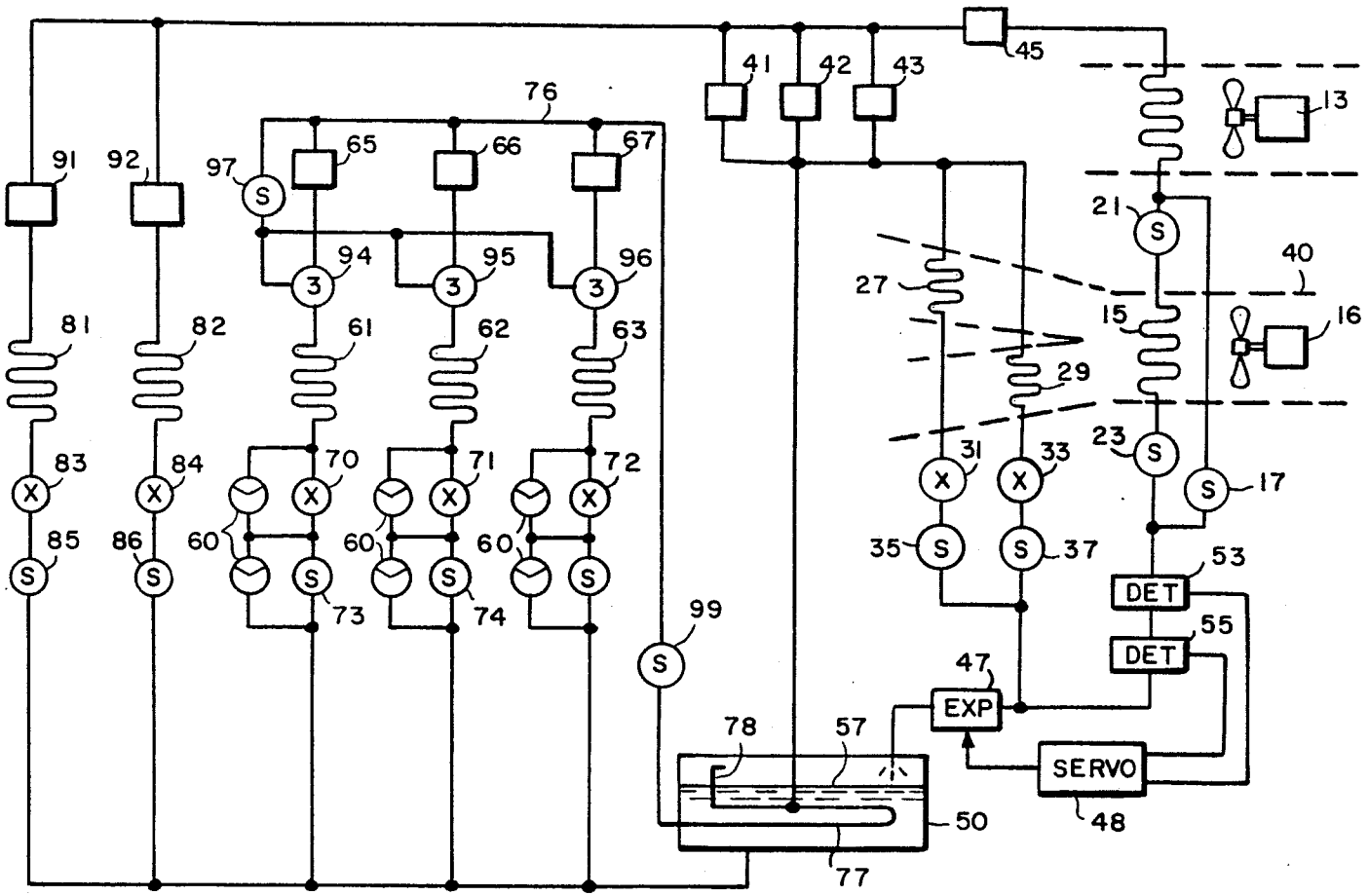
DET
DET
SERVO
EXP

REFRIGERATION

BACKGROUND OF INVENTION

The present invention relates to a refrigeration system and more particularly to a multi-temperature supermarket refrigeration system which is highly integrated and efficient.

The present invention deals with environmental concerns which are increasingly being expressed with respect to supermarket refrigeration systems. One of these concerns is the amount of energy being consumed to provide refrigeration and air-conditioning in such establishments. A further concern is with the amount and types of refrigerants currently being used. Present supermarket refrigeration systems typically employ very large quantities of chlorinated fluorocarbon refrigerants such as R6 which, when released into the atmosphere, are highly destructive of the ozone layer. While less environmentally damaging refrigerants are available, such as R22, these refrigerants are not well adapted to cooling cycles spanning large temperature differentials, such as those processes normally utilized in maintaining frozen foods.

Among the objects of the present invention may be noted the provision of an integrated multi-temperature refrigeration system; the provision of such a system which provides energy efficient operation; the provision of such a system in which the refrigerant thermal cycles span relatively small temperature differentials; the provision of such a system which can utilize environmentally preferable refrigerants; the provision of such a system which requires a relatively small refrigerant charge; the provision of such a system which is particularly adapted for use in a supermarket environment; the provision of such a system which facilitates the process of defrosting of evaporators employed in food freezers; the provision of such a system which is highly reliable and which is of relatively simple and inexpensive construction. Other objects and features will be in part apparent and in part pointed out hereinafter.

SUMMARY OF THE INVENTION

In accordance with one aspect of the present invention, a novel cascade mode of operation is employed which allows compressors serving low temperature loads to work over a pressure differential corresponding to a relatively small temperature difference. As compared with prior art systems in which separate refrigerant loops are employed with a heat exchanger between the loops, the system of the present invention utilized a shared refrigerant mass.

Briefly, a multi-temperature refrigeration system in accordance with the present invention employs a condenser for rejecting heat into the environment and provides at least one evaporator operating in a moderate temperature environment and at least one other evaporator operating in a relatively low temperature environment. At least one first compressor is utilized for drawing refrigerant from the moderate temperature evaporator and driving that refrigerant through the condenser. Refrigerant is provided to the moderate temperature evaporator from the outlet side of the condenser. Refrigerant from the outlet side of the condenser is also provided, through an expansion valve, to a processing vessel which allows gas and liquid phases of the refrigerant to separate. In the lower portion of the vessel, a heat exchanging conduit, normally submerged in liquid phase refrigerant, is connected to the outlet side of a compressor which draws refrigerant from the low temperature evaporator. Liquid phase refrigerant is provided to the low pressure evaporator from the lower portion of the vessel.

In accordance with another aspect of the invention, a selected low temperature evaporator is defrosted by directing refrigerant from the other compressors serving other low temperature evaporators back into the selected one of the low temperature evaporators.

BRIEF DESCRIPTION OF THE DRAWING

The single FIGURE is a schematic diagram of a multi-temperature refrigeration system constructed in accordance with the present invention.

DESCRIPTION OF THE PREFERRED EMBODIMENT

As indicated previously, the multitemperature refrigeration system of the present invention is highly integrated. In this regard, it utilizes many of the features of the refrigeration system described in my earlier patent, U.S. Pat. No. 4,803,848. The disclosure of that earlier patent is incorporated herein by reference. In particular, it is preferable that the system utilize a single condenser unit for ejecting heat into the environment. Such an integrated condenser is indicated by reference character 11 and its associated variable speed fan or blower by reference character 13. As described in the aforesaid patent, the speed of fan 13 is preferably controlled as a function of the total load of the system, wet bulb temperature, need for heat reclaiming, etc.

Refrigerant exiting from the condenser can pass into a heat recovery coil 15. The heat recovery coil, however, can be selectively bypassed by opening a shunt valve 17 and by closing valves 21 and 23. Heat recovery coil 15 is preferably incorporated into the air-conditioning system for the supermarket and, associated with the heat recovery coil, are air-conditioning and dehumidification coils 27 and 29. Refrigerant can be supplied to the coils 27 and 29 through respective expansion valves 31 and 33 from the outlet of the condenser, either directly or through the heat reclamation coil 15. Respective solenoid valves 35 and 37 are also provided in the supply lines so that the operation of the selected ones of these units can be cut-off as desired.

As described in the aforesaid patent, the air-conditioning and the dehumidifying coils can be used to selectively effect a subcooling of the refrigerant by being thermally coupled to the heat reclaim coil 15 by means of the air-conditioning duct work designated diagrammatically by reference character 40. A variable speed fan is provided for drawing air over these heat exchange coils in succession, also described in the aforesaid patent.

As is understood, the coils 27 and 29 constitute moderate temperature loads or evaporators, i.e., they operate at a temperature of about 40° Fahrenheit. Refrigerant is drawn through evaporators 27 and 29 by compressors 42 and 43 which operate over a corresponding moderate pressure differential. Multiple compressors are provided so that capacity can be varied by switching either of those units in or out. Refrigerant exiting the compressors 42 and 43 returns to the condenser 11 after passing through an oil separator, designated by reference character 45. Oil separator 45 extracts oil from the refrigerant flow, the recovered oil being distributed to all of the compressors in the system through respective supply lines and float valves, not shown. Because of the unique design of this system, typically only a single oil separator unit will be needed, since, in operation, all refrigerant used in the system will eventually pass through the oil separator unit 45, and situations which would cause the accumulation of oil elsewhere are avoided.

A portion of the refrigerant leaving the condenser 11 either directly or through the heat recovery coil 15, flows through a modulating expansion valve 47 into a refrigerant processing vessel 50. Expansion valve 47 is operated to maintain a predetermined column of liquid refrigerant above the expansion valve. For this purpose, a pair of detectors 53 and 55 are utilized for detecting the presence of liquid refrigerant at respective points in the conduit preceding the expansion valve. Photoelectric or ultrasonic detectors may be used. The valve 47 is operated by a suitable servo loop control as indicated at 48 so as to keep the level of liquid refrigerant between the two detectors so that the valve always has liquid refrigerant available to it, but the liquid refrigerant does not back up into the heat reclaim coil 15 or the condenser 11. By avoiding flooding of the condenser, the total charge of refrigerant which is necessary to operate the system under all conditions can be substantially reduced.

Expansion of refrigerant through valve 47 will typically produce a mixture of gas phase and liquid phase and the vessel 50 is of a size to allow the two phases to separate with the liquid settling into the lower portion of the vessel as indicated by reference character 57. Expansion of the refrigerant also produces a temperature in the vessel 50 comparable to those of the moderate temperature evaporators, e.g. 40° Fahrenheit.

Low temperature evaporators, e.g., those associated with frozen food or ice cream cases, are indicated by reference characters 61–63. Respective compressors are indicated at 65–67. While only three such evaporative loads are shown, it will be understood that the typical supermarket will in fact comprise many such loads. The low temperature evaporators are provided with cool liquid refrigerant from the lower portion of the vessel 50 through respective expansion valves 70–72. Respective controlling solenoid valves are also provided, as indicated at 73–75. As is conventional, the expansion and solenoid valves may be shunted by check valves 60 to allow refrigerant to return to the supply side if the pressure in the respective evaporator exceeds that of the supply.

The outlet sides of the compressors 65–67 are connected through a common line 76 to a heat exchanging conduit 77 which is normally submerged in the liquid phase refrigerant in the lower portion of the vessel 50. Heat exchange provided by the contact with the liquid phase refrigerant in the vessel 50 de-superheats refrigerant flowing from the compressors 65–67. Accordingly, it can be seen that the compressors 65–67 will operate over a relatively low pressure differential. As indicated previously, operation over relatively low pressure and temperature differentials results in improved efficiency and further permits the use of environmentally less hazardous refrigerants, such as R22.

An intake 78 is provided in the upper portion of the vessel for drawing off gas phase refrigerant. The intake 78 and the outlet of the heat exchange conduit 77 are connected together at a tee 79 and this point is also connected to the inlet side of the moderate temperature compressors 41 and 43. In passing through the conduit 77, refrigerant from the outlets of the compressors 65–67 is cooled to a temperature just above that of the liquid in the vessel 50. Mixing this gas flow with the saturated gas phase refrigerant brought in through the intake 78 results in an essentially dry gas flow going to the compressors 41 and 43. Further, since the refrigerant flow through the conduit 76 will proceed at a relatively steady velocity, oil will remain entrained and will be picked up and carried through the compressors 41–43 to the oil separator 45 so that no separate oil separator means is needed on the outlet sides of the low temperature compressors 65–67.

As will be understood, a typical supermarket application will require evaporators operating at temperatures in between those which are characteristic of the air-conditioning evaporators 27 and 29 on the one hand and the very low temperature evaporators, such as those indicated at 61 and 63, on the other. Such intermediate temperature evaporators, e.g., operating at 10° Fahrenheit and 20° Fahrenheit are indicated by reference characters 81 and 82 respectively. Liquid refrigerant is provided to these evaporators through respective expansion valves 83 and 84, with respective controlling solenoid valves being indicated at 85 and 86. The evaporators 81 and 82 are served by respective compressors 91 and 92 nd the outlet sides of these compressors are conveniently returned to the same common high side manifold 20 which also serves the compressors 41 and 43.

The embodiment illustrated also incorporates an exceptionally expeditious system for defrosting the various low temperature evaporators, such as those indicated at 61–63. Between each of these evaporators and its respective compressor is a three-way valve, these valves being designated by reference characters 94–96. The third leg of each of these three-way valves is connected, through a valve 97, to the common return line 76. This common return line incorporates a controlled solenoid valve 99 which can be selectively closed to prevent the flow of refrigerant back into the heat exchange conduit 77 in the vessel 50.

To effect defrosting of a selected one of the low temperature evaporator 61–63, the valve 97 is opened, the valve 99 is closed, and the respective three-way valve is turned so as to connect the common manifold 76 to the evaporator which is to be defrosted. At the same time, the compressor for that evaporator is deactivated. Hot gas in the manifold 76 generated by the other low temperature compressors will flow back into the evaporator which is to be defrosted, causing rapid melting of any ice accumulated thereon. The defrosting proceeds exceptionally quickly, since the evaporator being defrosted essentially becomes the entire condenser for the other low temperature branches. This method is particularly advantageous since it does not require the utilization of very high temperature gas, as would be present at the outlet of the various low temperature compressors if they were operating over the pressure and temperature differentials normally associated with single stage refrigeration systems. If the evaporator coil being defrosted fills up with liquid, the pressure will eventually exceed that corresponding to that in the pressure vessel and refrigerant will push back through the check valves 60.

In view of the foregoing it may be seen that several objectives of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A multi-temperature refrigeration system comprising:

a condenser for rejecting heat into the environment;

at least one evaporator operating in a moderate temperature environment;

at least one first compressor drawing refrigerant from said moderate temperature evaporator and driving refrigerant through said condenser;

means for providing refrigerant from the outlet side of said condenser to said moderate temperature evaporator;

at least one evaporator operating in a low temperature environment;

at least one second compressor drawing refrigerant from said low temperature evaporator;

a refrigerant processing vessel for receiving and allowing to separate a mixture of gas phase and liquid phase refrigerant;

the liquid phase refrigerant settling to the lower portion of said vessel;

means for providing refrigerant from the outlet side of said condenser to said vessel;

means for providing gas phase refrigerant from said vessel to the inlet of said first compressor; and in the lower portion of said vessel, a heat exchanging conduit which is normally submerged in a liquid phase refrigerant, the outlet of said second compressor being connected to the inlet end of said heat exchanging conduit.

2. A system as set forth in claim 1 wherein refrigerant is provided from said condenser to said vessel through an expansion valve.

3. A system as set forth in claim 2 wherein said expansion valve is controlled to prevent liquid phase refrigerant from backing up into said condenser.

4. A system as set forth in claim 2 wherein said system includes a heat reclaim coil which can be selectively interposed in the refrigerant path between said condenser and said vessel.

5. A system as set forth in claim 4 wherein at least one moderate temperature evaporator is thermally coupled to said heat reclaim coil for providing subcooling to refrigerant passing therethrough.

6. A multi-temperature refrigeration system comprising:

a condenser for rejecting heat into the environment;

at least one evaporator operating in a moderate temperature environment;

at least one first compressor drawing refrigerant from said moderate temperature evaporator and driving refrigerant through said condenser;

at least one evaporator operating in a low temperature environment;

at least one second compressor drawing refrigerant from said low temperature evaporator;

means for providing refrigerant from the outlet side of said condenser to said moderate temperature evaporator;

a refrigerant processing vessel for receiving and allowing to separate a mixture of gas phase and liquid phase refrigerant, the liquid phase refrigerant settling to the lower portion of said vessel;

means including an expansion valve for providing refrigerant in mixed phase from the outlet side of said condenser to said vessel;

in the lower portion of said vessel, a heat exchanging conduit which is normally submerged in liquid phase refrigerant, the outlet side of said second compressor being connected to the inlet end of said heat exchanging conduit; and in the upper portion of said vessel, an intake for drawing off gas phase refrigerant, said intake and the outlet end of said heat exchanging conduit being connected together and to the inlet side of said first compressor.

7. A system as set forth in claim 6 wherein said expansion valve is controlled to prevent liquid phase refrigerant from backing up into said condenser.

8. A multi-temperature refrigeration system comprising:

a condenser for rejecting heat into the environment;

at least one evaporator operating in a moderate temperature environment;

at least one first compressor drawing refrigerant from said moderate temperature evaporator and driving refrigerant through said condenser;

means for providing refrigerant from the outlet side of said condenser to said moderate temperature evaporator;

a plurality of evaporators operating in respective low temperature environments;

a plurality of compressors for drawing refrigerant from corresponding low temperature evaporators;

a refrigerant processing vessel for receiving and allowing to separate a mixture of gas phase and liquid phase refrigerant, the liquid phase refrigerant settling to the lower portion of said vessel;

means including an expansion valve for providing refrigerant from the outlet side of said condenser to said vessel;

means for providing gas phase refrigerant from said vessel to the inlet of said first compressor;

in the lower portion of said vessel, a heat exchanging conduit which is normally submerged in a liquid phase refrigerant, the outlets of the low temperature compressors being selectively connected to the inlet end of said heat exchanging conduit; and valve means for controllably disconnecting a selected one of said low temperature evaporators from the corresponding compressor and connecting it instead to the outlets of the other low temperature compressors thereby to effect defrosting of the selected evaporator.

9. A system as set forth in claim 8 wherein said valve means comprises a three-way valve between each low temperature evaporator and the corresponding compressor.

10. A system as set forth in claim 9 including a controllable valve for selectively blocking the connection between the outlets of the low temperature compressors and the inlet end of the heat exchanging conduit.

11. A multi-temperature refrigeration system comprising:

a condenser for rejecting heat into the environment;

a plurality of evaporators operating in moderate temperature environments;

a plurality of first compressors drawing refrigerant from said moderate temperature evaporators and driving refrigerant through said condenser;

means for providing refrigerant from the outlet side of said condenser to said moderate temperature evaporators;

a plurality of evaporators operating in respective low temperature environments;

a plurality of compressors for drawing refrigerant from said corresponding low temperature evaporators;

a refrigerant processing vessel for receiving and allowing to separate a mixture of gas phase and liquid phase refrigerant, the liquid phase refrigerant settling to the lower portion of said vessel;

means including an expansion valve for providing refrigerant in liquid phase from the outlet side of said condenser to said vessel;

in the lower portion of said vessel, a heat exchanging conduit which is normally submerged in liquid phase refrigerant, the outlet sides of the low temperature compressors being selectively connected to the inlet end of said heat exchanging conduit; and in the upper portion of said vessel, an intake for drawing off gas phase refrigerant, said intake and the outlet end of said heat exchanging conduit being connected together and to the inlet sides of said first compressors.

* * * * *